US008176686B2

(12) United States Patent
Santini

(10) Patent No.: US 8,176,686 B2
(45) Date of Patent: May 15, 2012

(54) STAGE AND ROOF SYSTEM

(76) Inventor: Patrick Santini, Fond du Lac, WI (US)

( * ) Notice: Subject to any disclaimer, the term of this patent is extended or adjusted under 35 U.S.C. 154(b) by 381 days.

(21) Appl. No.: 12/276,282

(22) Filed: Nov. 21, 2008

(65) Prior Publication Data

US 2009/0126281 A1 May 21, 2009

Related U.S. Application Data

(60) Provisional application No. 60/989,601, filed on Nov. 21, 2007.

(51) Int. Cl.

| | |
|---|---|
| ***E04H 3/26*** | (2006.01) |
| ***E04H 1/00*** | (2006.01) |
| ***E04B 1/346*** | (2006.01) |
| ***E04B 7/16*** | (2006.01) |

(52) U.S. Cl. ..... 52/7; 52/66; 52/69; 52/79.5

(58) Field of Classification Search ..... 52/7, 66, 52/6, 64, 67, 68, 69, 71, 79.5, 143

See application file for complete search history.

(56) References Cited

U.S. PATENT DOCUMENTS

| | | | | |
|---|---|---|---|---|
| 2,282,756 | A * | 5/1942 | Curran | 52/73 |
| 3,175,718 | A * | 3/1965 | Voorhees et al. | 414/499 |
| 3,181,203 | A * | 5/1965 | Wenger | 52/6 |
| 3,202,159 | A * | 8/1965 | Reed | 135/88.17 |
| 3,258,884 | A * | 7/1966 | Wenger | 52/6 |
| 3,458,232 | A * | 7/1969 | Frank | 296/156 |
| 3,596,977 | A * | 8/1971 | Bunger | 296/160 |
| 3,638,373 | A * | 2/1972 | Chapman | 52/92.2 |
| 4,027,912 | A * | 6/1977 | Pacca | 296/160 |
| 4,112,863 | A * | 9/1978 | Nelson | 114/264 |
| 4,633,615 | A * | 1/1987 | Moose | 49/425 |
| 4,720,945 | A * | 1/1988 | Berranger et al. | 52/7 |
| 5,078,442 | A * | 1/1992 | Rau et al. | 296/26.02 |
| 5,152,109 | A * | 10/1992 | Boers | 52/143 |
| RE34,468 | E * | 12/1993 | Rau et al. | 296/26.02 |
| 5,327,698 | A * | 7/1994 | Uhl | 52/68 |
| 5,400,551 | A * | 3/1995 | Uhl | 52/68 |
| 5,546,709 | A * | 8/1996 | Decker et al. | 52/66 |
| 5,716,090 | A * | 2/1998 | Chang et al. | 296/26.01 |
| 5,950,568 | A * | 9/1999 | Axelrod et al. | 119/499 |
| 5,979,125 | A * | 11/1999 | Guillet | 52/143 |
| 6,393,769 | B1 * | 5/2002 | Mertik et al. | 52/7 |
| 6,460,485 | B1 * | 10/2002 | Burg | 119/431 |
| 6,588,061 | B2 * | 7/2003 | Becken | 16/105 |
| 6,679,023 | B2 * | 1/2004 | Rizzotto | 52/653.2 |
| 6,948,702 | B1 * | 9/2005 | Nigro | 254/423 |
| 7,025,019 | B2 * | 4/2006 | Axelrod et al. | 119/499 |
| 7,218,848 | B2 * | 5/2007 | Hinesley | 392/420 |
| 2004/0112613 | A1 * | 6/2004 | McGivery | 172/25 |
| 2005/0044804 | A1 * | 3/2005 | Bin et al. | 52/79.5 |

* cited by examiner

*Primary Examiner* — Eileen D Lillis
*Assistant Examiner* — Andrew Triggs
(74) *Attorney, Agent, or Firm* — Donald J. Ersler

(57) ABSTRACT

Disclosed is a structure that is a stage and roof system. The present invention is a system that allows a stage and roof system to be moved and folded up into a compact area in a very short period of time to be placed at an event location to broadcast talent directly on or near a terrain.

11 Claims, 7 Drawing Sheets

STAGE AND ROOF SYSTEM

This application claims priority to U.S. Provisional Application 60/989,601, filed Nov. 21, 2007, the entire disclosure of which is incorporated by reference.

TECHNICAL FIELD AND BACKGROUND

The present invention relates to a stage and roof system. More specifically, the present invention is a system that allows a stage and roof system to be moved easily and be folded up into a compact area in a very short period of time at an event location. The short period of time may be under 40 seconds. The difference between the present invention and other existing systems is the downstage forward lifting arms substantially eliminate any obstructions on the upstage area. When desired, this allows the viewing area of filming cameras to view the background of an event location while talent on the stage is in the foreground. The talent and event location together may show without any obstruction. The present invention has a retracting light or lamp bar that extends outward from the stage and can retract while leaving light fixtures on the bar. The present invention may have in-floor ducts with at least one stage vent for cooling and heating the talent and/or equipment.

The present invention also has recessed tracks in the floor for cables to run unseen from various areas of the set. In the folded position, the present invention structure maintains a minimal height. The folded height may be under four feet for NFL playing field requirements or under five feet tall and under eight feet wide. The present invention structure also has a double-wheel steering system that allows the wheels to spin continuously, so the structure or stage and roof system can be steered in any direction. The present invention also uses a double wheel assembly, so when the wheels turn in a tight radius, they do not damage the terrain.

The present invention has lifting arms to raise and lower the roof. These lifting arms are the key parts to the structure making it unique. The mechanical arms are able to lift the roof structure along with the weight of any lighting, audio, video, or other such related equipment attached to the edge of the roof at any given point.

The present invention utilizes the use of hydraulic cylinders to achieve the lifting force for the roof along with basic levers and pivots. The present invention also utilizes independent hydraulic cylinders that control leveling feet in each corner of the stage for leveling the stage deck that can be raised to heights between 18 inches and four feet. These leveling pads are interchangeable with rollers that utilize a track system for moving the stage precisely from one position to another and back again. This ensures the same placement of the present invention if it needs to move on and off a set position. All of the hydraulic components are controlled using a multi-button remote control pendant.

The present invention can be used for various sporting or music events, tradeshows, performances, and other events that will need a quick setup involving a roof and/or stage, and the stage and roof system can be placed on a particular event location or terrain that my need to show an unobstructed view of the event location in the background of a broadcast. The present invention may roll through an opening that is eight feet wide and five feet tall to enter an area and setup in a minimal amount of time. The present invention also holds the roof up only from the downstage edge, eliminating upstage obstructions for set and viewing. The present invention has an integrated curtain track to protect the contents and/or subjects on the stage from the elements, as well as being used as a backdrop.

The present invention has three hundred sixty degrees of steering allowing the structure to be steered in any direction and move the stage into any position. The present invention has a double-wheel assembly in order to refrain from damaging the terrain in tight steering situations. The present invention has a multi-folding stage platform to reduce size during storage and transport and to allow for rapid setup. The present invention has a completely self-contained battery-operated hydraulic system to accommodate operation in any location without the need of external power. The present invention also has an on-board charging system to recharge the batteries. The present invention has recessed floor boxes that run underneath the stage deck to conceal the cable runs, electronics, and power boxes from being visible. The present invention has dual quad lifting arms to raise and lower the roof system from the front of the stage. The roof can be folded to reduce size for transport, storage, and rapid setup. The present invention roof also has a retracting lamp bar to hang lighting equipment and can retract for storage or travel. The continuous rotating steering system utilizes a chain drive system to achieve the continuous rotation.

BRIEF DESCRIPTION OF THE DRAWINGS

The objects, features, and advantages of the present invention will be apparent from the following detailed description of the preferred embodiment of the invention with references to the following drawings.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials, and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention; however, the order of description should not be construed as to imply that these operations are necessarily order dependent. In particular, these operations need not be performed in the order of presentation.

The phrase "in one embodiment" is used repeatedly. The phrase generally does not refer to the same embodiment; however, it may. The terms "comprising," "having," and "including" are synonymous, unless the context dictates otherwise.

Figure 1:
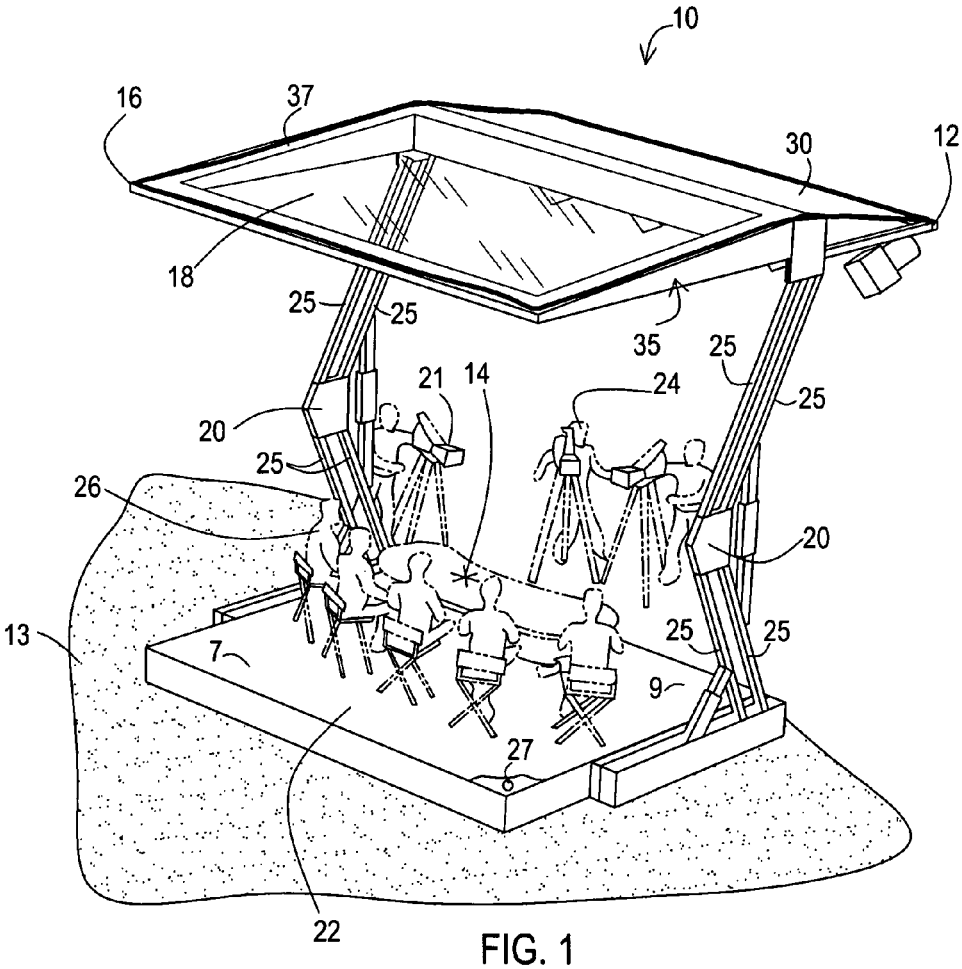
FIG. 1 is a view of the stage and roof system as in one embodiment in accordance with the present invention.

Referring to FIG. 1, as in one embodiment, is a back perspective view of the stage and roof system 10. Shown is retracting light or lamp bar 12 that is capable of supporting hundreds of pounds of load and allows lights to be left on during transport and while moving on and off an event location or terrain 13. A multi-pin audio snake 14 is shown for quick setup of microphones. A support channel and gutter system 16 is shown that can funnel water to the side so that water does not pool on the roof system 35 and cause sagging of the roof skin 18. A roof skin 18 is used to protect talent 26 from environmental conditions. The talent may be commentators or presenters. The roof system 35 folds 41 and is able to stay attached to the stage 22 when the stage and roof system 10 is collapsed to its folded form. The roof system 35 may have a roof skin 18, front awning 30, and back awning 37 that can be separated from the roof system 35 while the retracting light bar 12 remains in place. Also shown are the folding points 20 of the lifting arms 25 and the multi-fold stage platform or stage 22. Camera personnel 24 are shown in front of the stage 22 and may be under the roof system 35.

In FIG. 1, commentators or presenters or talent 26 can be easily seen by viewers of the broadcast with the event location 13 in the background or behind the talent 26. Viewers of the event location 13 through the feed from the cameras 21 can easily see the commentators or presenters 26 with the terrain 13 behind the commentators or presenters 26 because of the openness of the stage and roof system 10. This openness gives the viewer of the broadcast feed from the cameras an unobstructed image of the talent directly at the event location. When used in television broadcasting, the viewer at home also has the excitement of seeing the commentators or presenters 26 actually on the event location or terrain 13 during and/or around the time an event is occurring on the terrain 13. This excitement of being directly on the event location can include sounds of a game or event, players talking, and people showing up impromptu on the stage 22. The openness of the stage and roof system 10 is accomplished by using lifting arms 25 that are attached to the stage 22 downstage 9. By connecting the lifting arms 25 downstage 9 there is an unobstructed view of the event location 13 to the viewers of the broadcast feed through the cameras 21 upstage 7. A removable steering wheel 27 is shown to control wheels under the stage 22 for easy maneuverability and mobility of the stage and roof system 10. The stage 22 may be covered with carpet that can be pulled back to expose the steering wheel 27 that has a connector.

Figure 2:
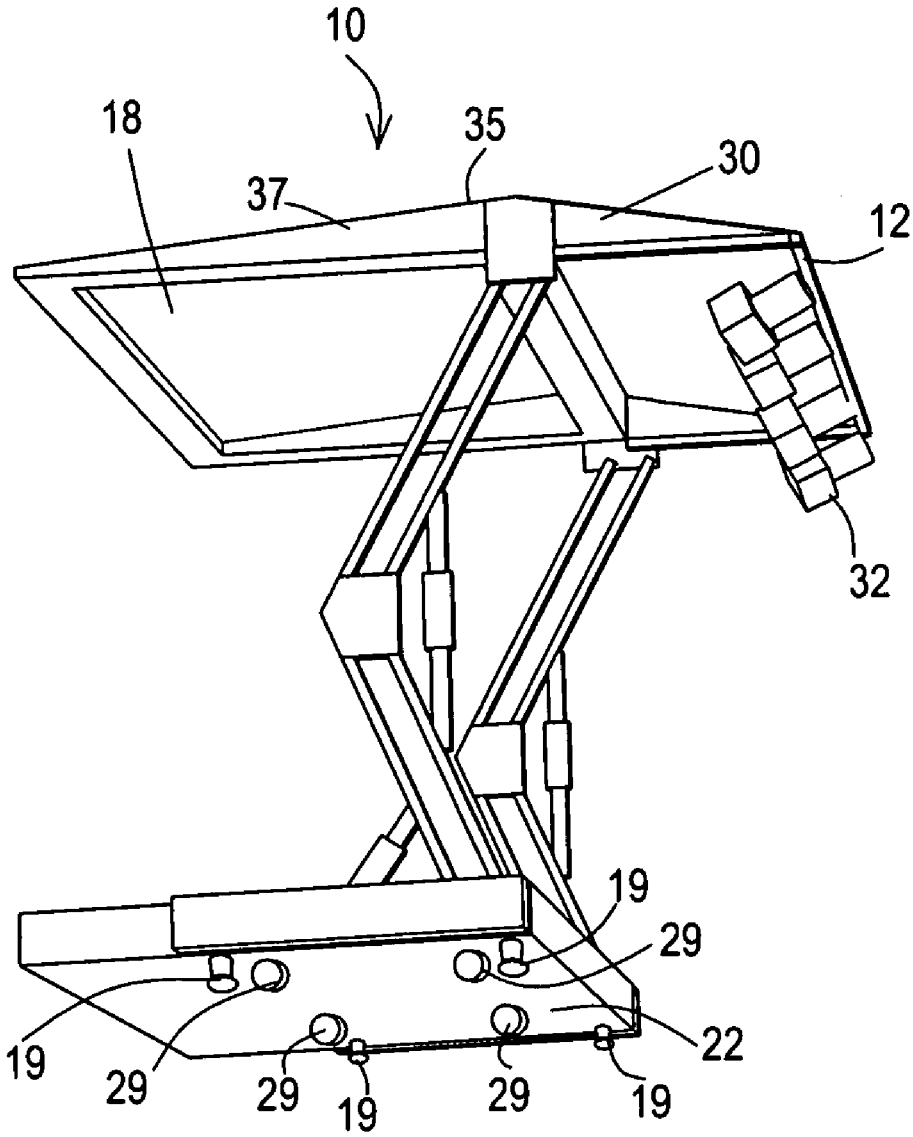
FIG. 2 is a view of the stage and roof system as in one embodiment in accordance with the present invention.

FIG. 2, as in one embodiment, is a side perspective view of the stage and roof system 10. Shown is a front awning 30 with a retracting light or lamp bar 12. The front awning 30 may cover cameras 21 and camera personnel 24 to protect from weather and possible hazardous environmental conditions at event location 13. The awning 30 allows for lighting equipment 32 to be mounted on the roof system 35. Also shown is the roof skin 18 and the stage or stage platform 22. The front awning 30 retracts into back awning 37 while allowing the lighting equipment 32 to remain in place. The retracting front awning 30 allows the stage and roof system 10 to be more compact and mobile. Shown are stage levelers 19 and terrain wheels 29. The terrain wheels 29 may have a steering system to connect to a steering wheel 27 to control the stage and roof system 10 movement.

Figure 3:
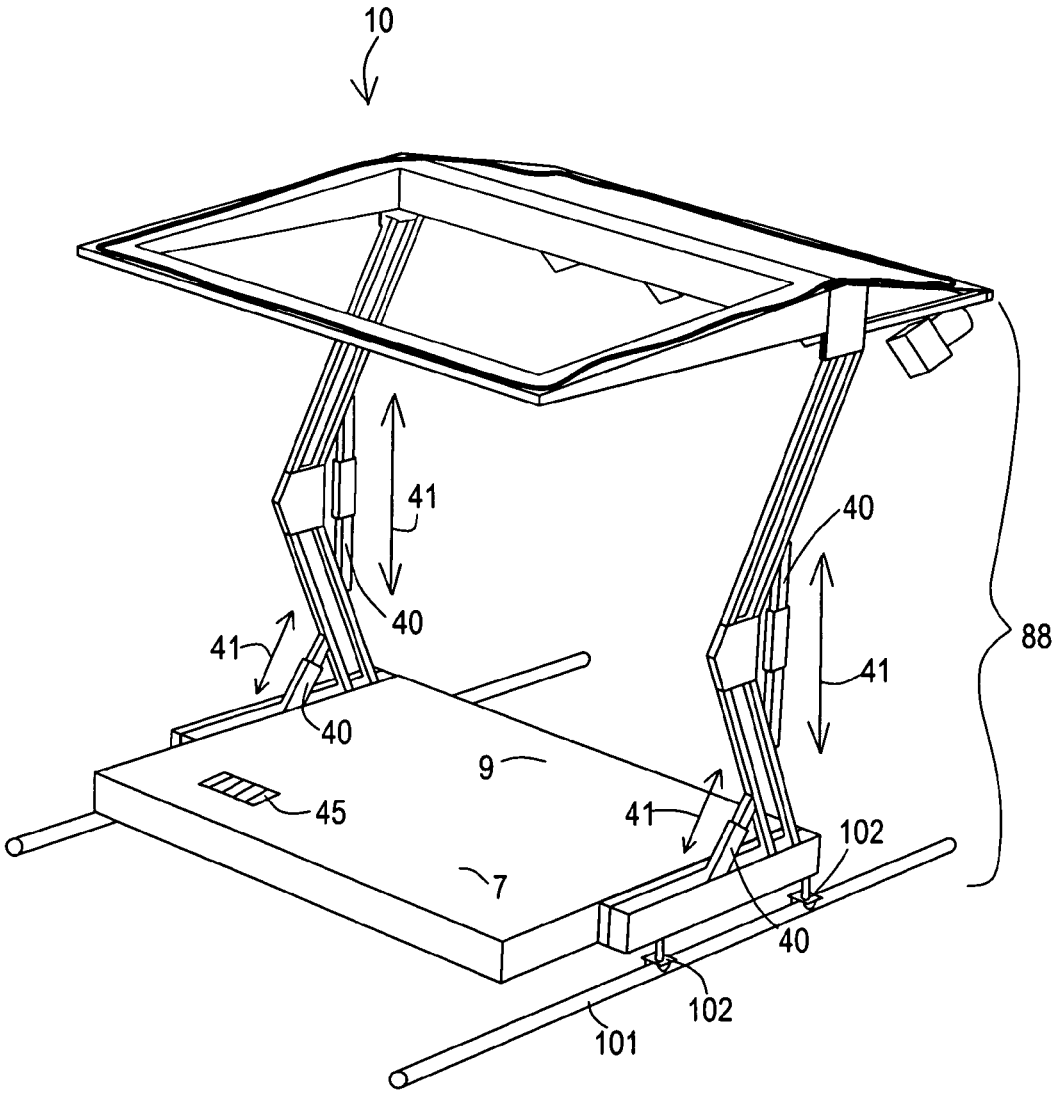
FIG. 3 is a view of the stage and roof system as in one embodiment in accordance with the present invention.

FIG. 3, as in one embodiment, is a side perspective view of the stage and roof system 10 with hydraulic cylinders 40 that extend and contract to raise and lower 41 the roof system 35 allowing the stage and roof system 10 to be in a fully extended position 88 and a fully collapsed position 99. Shown is a stage vent 45 that will allow heating, cooling, or anything else that can be pumped into a duct such as smoke for dramatic effect. The stage vent 45 may be used to keep the talent 26 comfortable in different weather or temperature conditions. Shown are grooved wheels 102 that ride on a rail 101 for exact placement and replacement when the stage needs to be moved on and off a set position. Downstage 9 and upstage 7 are shown.

Figure 4:
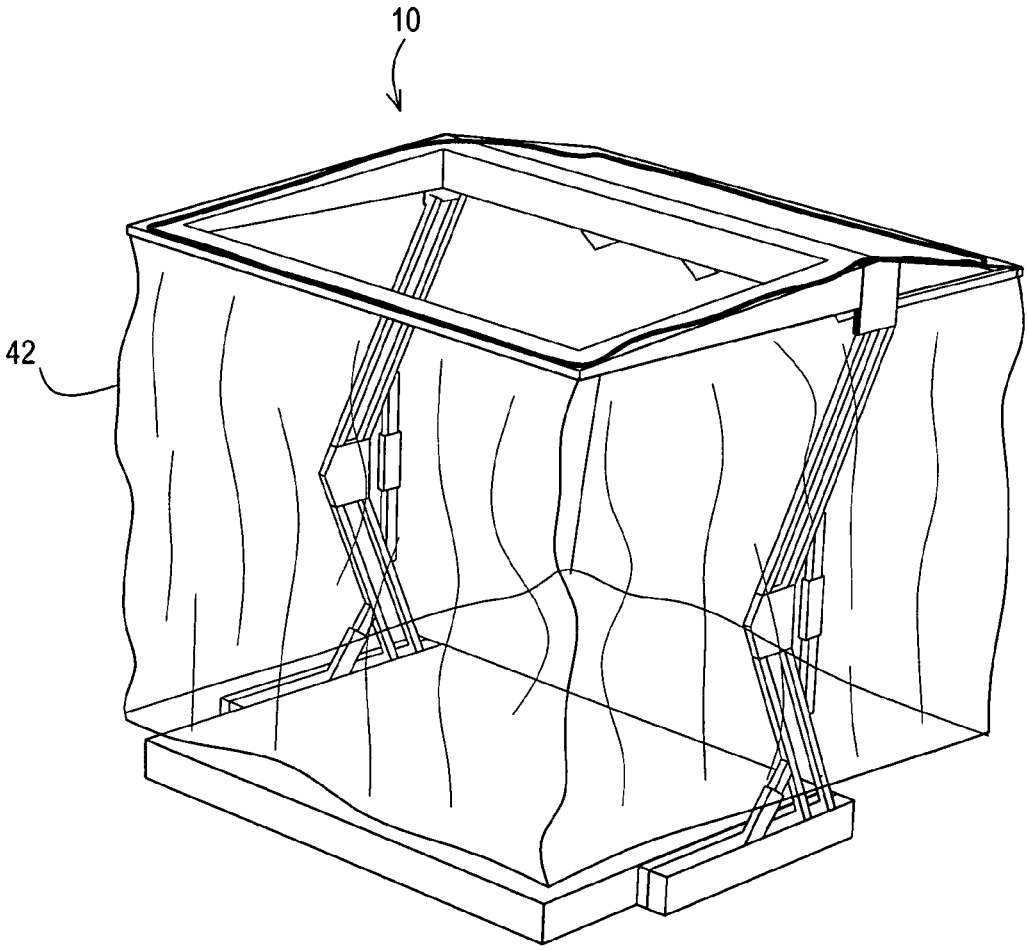
FIG. 4 is a view of the stage and roof system as in one embodiment in accordance with the present invention.

FIG. 4, as in one embodiment, is a perspective view of the stage and roof system 10 with curtain 42 extended to keep the talent 26 and/or camera personnel 24 or any equipment protected from weather or environmental conditions. The curtain 42 can be completely removed or gathered.

Figure 5:
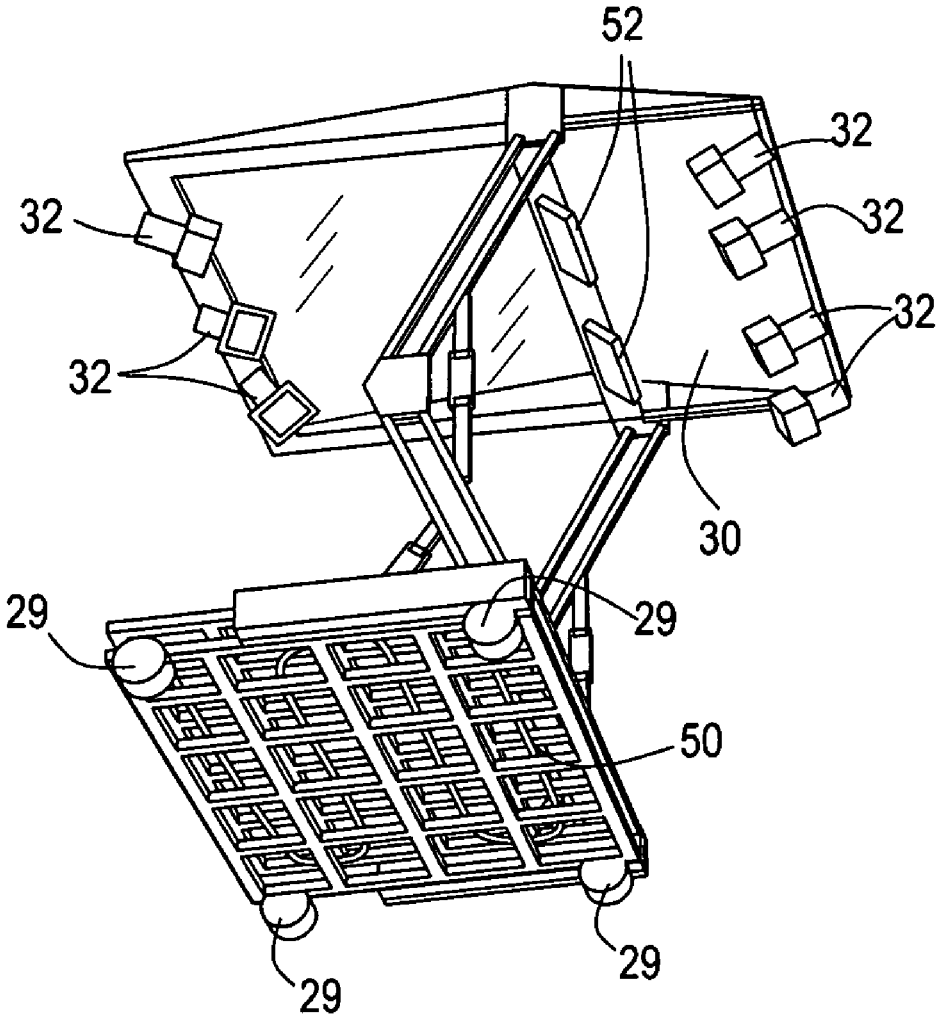
FIG. 5 is a view of the stage and roof system as in one embodiment in accordance with the present invention.

FIG. 5, as in one embodiment, is a side perspective view of stage and roof system 10 showing heaters 52 above the talent 26. Heaters 52 allow for individual temperature control of each talent 26. Shown is lighting equipment 32 on roof system 35. Duct work 50 is under stage 22 to feed stage vent 45 air at a desired air temperature needed to make the talent 26 comfortable. Duct work 50 may also supply smoke to stage vent 45 for dramatic effect. Wheels 29 are shown that provide quick mobility of the stage and roof system 10 and lower damage to the terrain 13.

Figure 6:
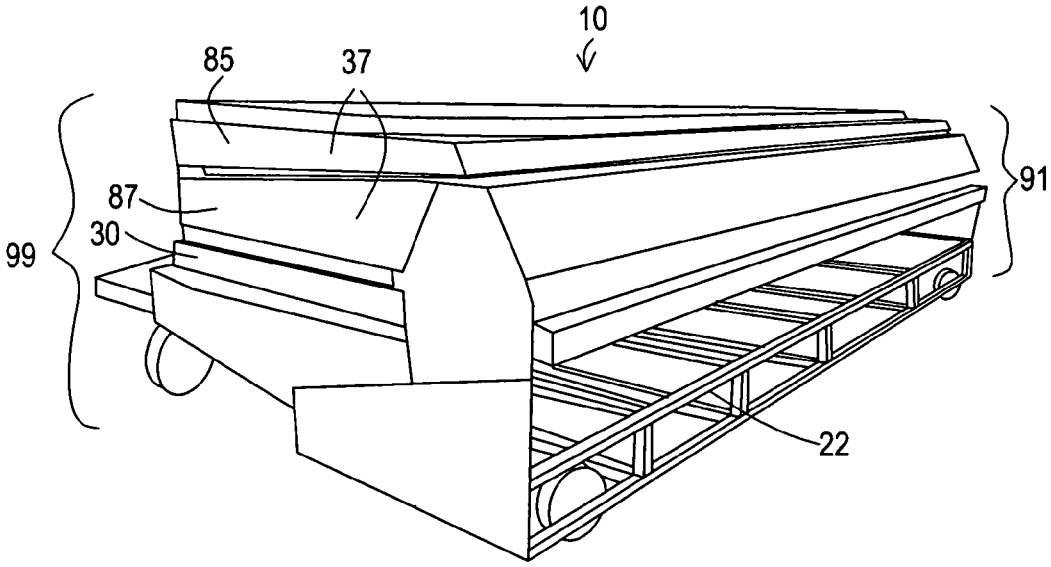
FIG. 6 is a view of the stage and roof system as in one embodiment in accordance with the present invention.

FIG. 6, as in one embodiment, is a side perspective view of the stage and roof system 10 in a collapsed position 99. Back awning 37 is folded with a first awning 85 on top of a second awning 87 all on top of retracted front awning 30. Stage 22 is below the folded back awning 37 and retracted front awning 30. A collapsed stage and roof system height 91 is shown. The collapsed stage and roof system height 91 may then be four feet. In some applications, four feet may be the maximum height the collapsed stage and roof system 99 can be so a fan in the lowest seat of a stadium can see over the collapsed position 99 of the stage and roof system 10.

Figure 7:
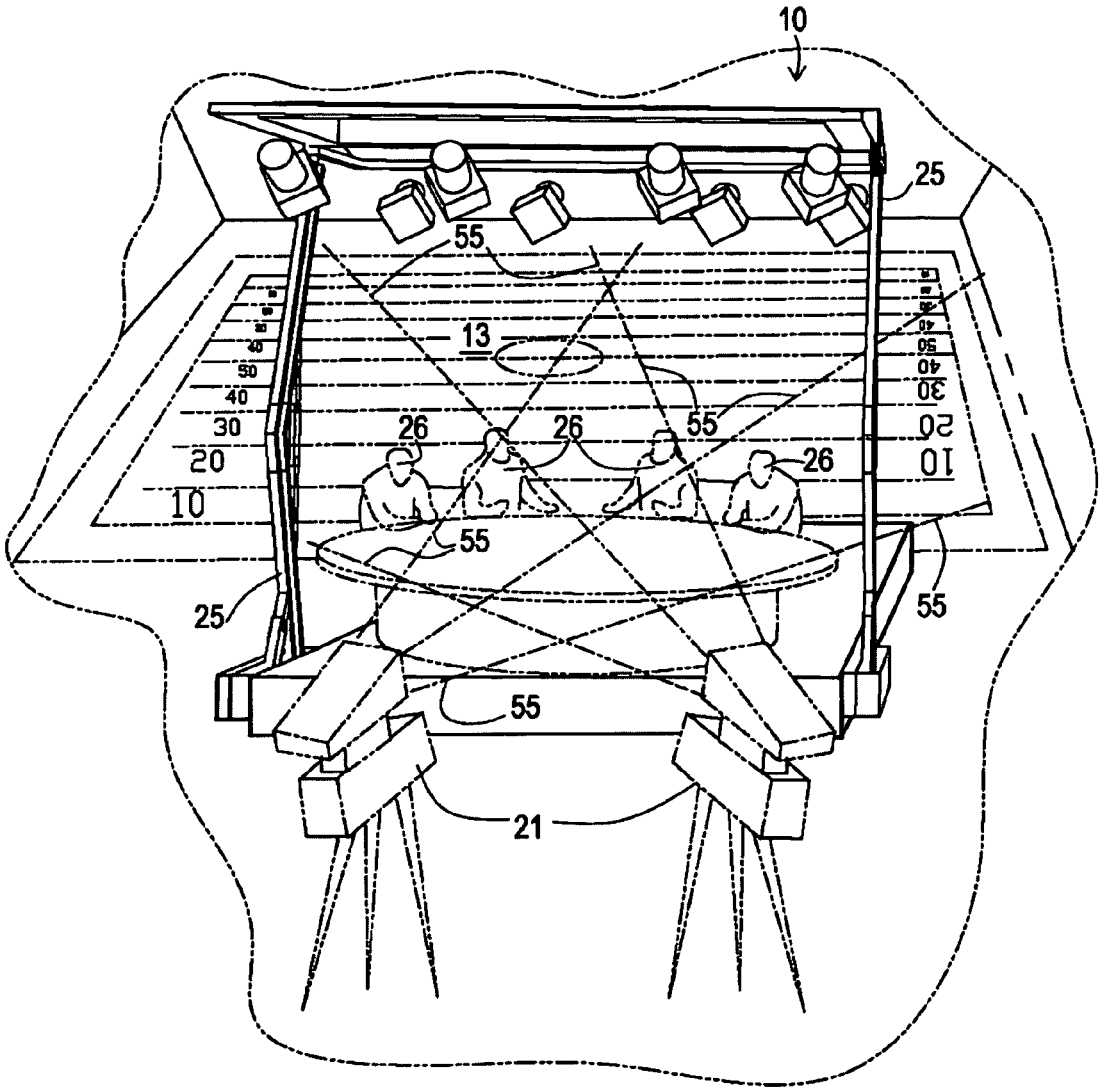
FIG. 7 is a view of the stage and roof system as in one embodiment in accordance with the present invention.

FIG. 7, as in one embodiment, is a front view of the stage and roof system 10. Cameras 21 are shown with a camera line of sight 55. Camera line of sight 55 points to the talent 26 and terrain 13 at the same time while the camera line of sight 55 misses the lifting arm or arms 25 in the broadcast to viewers. Cameras 21 may zoom in and out to include lifting arm or arms 25.

The stage and roof system has a quick release, detachable downspout that attaches to a water hose to funnel water away from the set and keep droplets from dripping in camera views. A gutter runs the entire length of the upstage edge allowing it to collect the water that flows off the roof canopy. It is attached to the downspout for water disposal.

The roof skin is usually made out of a clear, vinyl, waterproof material. This material is usually made clear to implement the use of graphics to be seen from overhead and from underneath. It also has quick detachable clips on the downstage lamp bar so it can be removed with the roof structure while leaving the lamp bar unaffected. The clear skin also allows for natural or ambient light to reach the set. The skin may also be made of vinyl of different colors to achieve a desired look or to block light in certain circumstances. A curtain track runs upstage and side stage allowing for a quick application of curtains or sidewalls for both weather and light protection. These curtains can also be made out of clear or colored vinyl or another material.

The roof canopy is made of aluminum and has a single folding point allowing it to fold to half of its size very quickly and easily. It has a taper or pitched design, so when it is folded in half, it becomes a rectangle, minimizing the collapsed space required to store the unit. The taper is also designed to guide the flow of water into the gutter at the upstage edge of the roof. The folding point of the roof structure allows the tapered roof design to collapse by 50% of size and only gain 3" in overall height. By removing four bolts on each side, the roof can be removed separately from the lamp bar and lifting arms.

Four hydraulic cylinders actuate the upper lifting arms of the support system. These cylinders are mounted on the side of the lifting arms to allow the system to achieve a minimal collapsed height. The upper cylinders use hydraulic flow combiner/divider valves to allow even hydraulic flow between the two arms. They also utilize counterbalance valves to allow only power up and power down operations to avoid collapse if a hose, line, or other part of the hydraulic system were to become compromised.

Quad lifting arms raise and lower the roof canopy and lamp bar. They are comprised of two upper arms and two lower arms that join in the center by a knuckle. There is one of these assemblies located on each side of the stage to support the roof canopy and lamp bar. The mounting holes on the base, knuckle, and roof are offset to allow the lifting arms to fold flat to minimize the folded height and allow for maximum compaction of the stage and roof system.

Dual lifting hydraulic cylinders are located one on each side of the stage. These cylinders actuate the lower set of arms that raise and lower the roof canopy and lamp bar. The lower cylinders use hydraulic flow combiner/divider valves to allow even hydraulic flow between the two arms. They also utilize counter balance valves to allow only power up and power down operations to avoid collapse if a hose, line, or other part of the hydraulic system were to become compromised. The mounting of the lower cylinders are offset from the support arms to allow the arms to fold flat in a collapsed state.

The lifting arm assembly is the part of the structure that makes it key for the application. The lifting arms, when extended from the base, raise the roof canopy to a variable height from four feet to 18 feet. The arms are located on the downstage edge of the base platform. When extended, the arms only support the roof and lamp bar by the downstage edge, completely clearing the upstage of the platform of any obstructions. Most conventional roof systems utilize a four corner design; the present invention utilizes a two point design yet it still provides the same function.

Electronic hydraulic valves are used to operate the lifting arm cylinders and leveling cylinders. The stage and roof system has a hydraulic reservoir used to house bio-degradable hydraulic fluid. Bio-degradable hydraulic fluid is used to ensure there are no environmental hazards if damage to the system were to cause any type of spillage or leakage.

A two inch pipe is used for lamp rigging. The pipe has been inset six inches to allow lighting fixtures to be hung and remain under the roof giving them protection from the weather. The pipe runs the length of the downstage edge of the lamp bar assembly but stops two inches short of the lamp bar supports on each end to allow it to achieve full retraction when the lamp bar assembly is retracted. Another two inch pipe inset six inches provides additional rigging or hanging points for lighting, video, audio, or other equipment. This pipe runs along the upstage and side stage edges of the roof canopy.

Eight UHMW rollers with roller bearings allow for smooth retraction of the lamp bar. There are two rollers above the bar and two below the bar on each side of the stage. Since the lamp bar may not need to be retracted completely in various situations, there are pin holes in different locations to accommodate the placements.

The infrared heaters mounted overhead allow a heat source to heat talent or presenters on the stage that will not blow away in an open air environment. LP gas heaters can also be used to provide a high volume of forced air to heat the talent or equipment on the stage through the floor vents on the left and right sides of the stage Detachable duct work is then attached to the stage. Ducting allows the heat to be provided to the stage but allows the heaters to be kept away from the stage and the noise out the camera audio range.

The stage has recessed floor pockets that can be used to house electrical connections, audio connections, video connections, or other types of connections. They are located in various areas of the stage surface and can be moved around the deck to accommodate the type of application. The floor pockets have a hinged cover to conceal them. The door to these pockets has a notch to allow cables to exit the box and still allow the cover to close. The stage has a floor track that allows cables or fiber connections to reach the center of set without being seen by camera viewing.

An offset hinge is used at the folding point of the stage platform to fold the second stage of the tail platform. The offset hinge allows the platform to fold over 90% and lay flat on the second platform. A D-ring or lifting ring gives a point to where the stage can be lifted or towed. These rings are located on both sides of the stage.

The leveling system is located on the stage base. The levelers are both independently operated by both hydraulics and screw actuation. There are levelers located on both the left and right side of the structure. Having independent levelers in multiple locations ensures proper leveling on most any terrain. The levelers have a spring-pin connection on the end allowing for multiple attachments to be used. A dish or landing pad, dolly or track wheels, scaffold adaptors, or other attachments can be used. Any device with the connection may be adapted to work with said fitting.

There are four locations that the wheels are positioned. Each wheel assembly has dual pneumatic foam filled tires allowing an airless operation and a much greater weight capacity and eliminates the possibility of a flat tire. The foam allows the tires to be punctured and still function. The purpose of the dual tires is both weight dispersion and to reduce the damage and wear to the terrain at the event location. When used in a tight-turning situation, the dual wheel design has a center axis which rolls the tire around the axis versus a single-center axis tire that grinds over the center causing wearing on event location surfaces.

There are two independent steering systems located on either side of the stage, one on the left side and one on the right. The system links the two wheels together via a continuous chain going over a sprocket mounted on the center shaft of the tires. The chain also goes over a third shaft connected to the steering control. The chain is then tensioned and aligned with idler sprockets. All sprocket shafts have keyways to eliminate sprocket slipping. The chain system allows the wheels to rotate 360° to steer in any horizontal direction. Both sides of the stage are independent of each other.

Four 6-volt batteries are wired in series to deliver 24 volts of high amperage power to the hydraulic pump motor. There batteries are charged with a 24-volt battery trickle charger allowing the system to be completely self-contained. A controller connection box houses a water-tight multi-pin connector to connect to a remote control pendant that operates the electric hydraulic valves and pump.

While the present invention has been related in terms of the foregoing embodiments, those skilled in the art will recognize that the invention is not limited only to the embodiments described. The present invention can be practiced with modification and alteration within the spirit and scope of the appended claims. Thus, the description is to be regarded as illustrative instead of restrictive on the present invention.

What is claimed is:

1. A stage and roof system comprising:

a stage and a roof system;

a folding support includes a first folding arm and a second folding arm, said first folding arm includes two first lower arms and two first upper arms, said second folding arm includes two second lower arms and two second upper arms, one end of said two first lower arms are pivotally retained relative to one end of said first upper arms, one end of said two second lower arms are pivotally retained relative to one end of said two second upper arms, the other end of said two first lower arms are pivotally retained on a first side of said stage, the other end of said two second lower arms are pivotally retained on a second side of said stage, the other end of said two first upper arms are pivotally retained on a first side of said roof system, the other end of said two second upper arms are pivotally retained on a second side of said roof system, wherein said roof system and said stage are in a substantially horizontal orientation when said stage and roof system is in a collapsed position;

means for raising and lowering said first and second folding arms;

at least four terrain wheels are pivotally retained on a bottom of said stage; and a steering deice for controlling a direction of said at least four terrain wheels.

2. A stage and roof system of claim 1, further comprising:

a plurality of stage levelers extend from a bottom of said stage.

3. A stage and roof system of claim 1 wherein:

a collapsed height of said stage and roof system is under four feet.

4. A stage and roof system of claim 1 wherein:

said means for raising and lowering is a first lower actuator, a first upper actuator, a second lower actuator and a second upper actuator.

5. A stage and roof system comprising:

a stage and a roof system;

a folding support includes a first folding arm and a second folding arm, said first folding arm includes two first lower arms and two first upper arms, said second folding arm includes two second lower arms and two second upper arms, one end of said two first lower arms are pivotally retained relative to one end of said first upper arms, one end of said two second lower arms are pivotally retained relative to one end of said two second upper arms, the other end of said two first lower arms are pivotally retained on a first side of said stage, the other end of said two second lower arms are pivotally retained on a second side of said stage, the other end of said two first upper arms are pivotally retained on a first side of said roof system, the other end of said two second upper arms are pivotally retained on a second side of said roof system, wherein said roof system and said stage are in a substantially horizontal orientation when said stage and roof system is in a collapsed position;

means for raising and lowering said first and second folding arms; and a track system includes a pair of rails and a plurality of rollers, said track system is retained on a support surface, said plurality of rollers are pivotally retained on a bottom of said stage.

6. A stage and roof system of claim 5 wherein:

a collapsed height of said stage and roof system is under four feet.

7. A stage and roof system of claim 5 wherein:

said means for raising and lowering is a first lower actuator, a first upper actuator, a second lower actuator and a second upper actuator.

8. A stage and roof system comprising:

a stage and a roof system, said roof system includes a front awning and a back awning;

a folding support includes a first folding arm and a second folding arm, said first folding arm includes two first lower arms and two first upper arms, said second folding arm includes two second lower arms and two second upper arms, one end of said two first lower arms are pivotally retained relative to one end of said first upper arms, one end of said two second lower arms are pivotally retained relative to one end of said two second upper arms, the other end of said two first lower arms are pivotally retained on a first side of said stage, the other end of said two second lower arms are pivotally retained on a second side of said stage, the other end of said two first upper arms are pivotally retained on a first side of said roof system, the other end of said two second upper arms are pivotally retained on a second side of said roof system, wherein said roof system and said stage are in a substantially horizontal orientation when said stage and roof system is in a collapsed position;

means for raising and lowering said first and second folding arms; and said back awning includes a first section and a second section, one end of said first section is located adjacent the other ends of said first and second folding arms, the other end of said first section is pivotally attached to one end of said second section, wherein said second section folds over a top of said first section in a collapsed position.

9. A stage and roof system of claim 8, further comprising:

a plurality of stage levelers extend from a bottom of said stage.

10. A stage and roof system of claim 8 wherein:

a collapsed height of said stage and roof system is under four feet.

11. A stage and roof system of claim 8 wherein:

said means for raising and lowering is a first lower actuator, a first upper actuator, a second lower actuator and a second upper actuator.

* * * * *